United States Patent [19]

Farrell

[11] 3,968,377

[45] July 6, 1976

[54] BEAM SPLITTING TO IMPROVE TARGET LIFE IN NEUTRON GENERATORS

[75] Inventor: Joseph Paul Farrell, East Setauket, N.Y.

[73] Assignee: Radiation Dynamics, Inc., Westbury, N.Y.

[22] Filed: Aug. 14, 1974

[21] Appl. No.: 497,486

[52] U.S. Cl. ..... 250/499; 250/500

[51] Int. Cl.[2] ..... G21G 4/02

[58] Field of Search ..... 250/499–502, 250/396, 398, 399; 313/618

[56] References Cited

UNITED STATES PATENTS 3,124,711 3/1964 Reifenschweiler ..... 250/501 UX 3,846,636 11/1974 Zehr et al. ..... 250/499

*Primary Examiner*—Davis L. Willis

*Attorney, Agent, or Firm*—Rose & Edell

[57] ABSTRACT

In a neutron generator of the type in which a tritium-titanium target is bombarded by a deuterium ion beam, the target half-life is increased by separating the beam with a weak magnetic field to provide three separate beams of atomic, diatomic and triatomic deuterium ions which all strike the target at different adjacent locations. Beam separation in this manner eliminates the problem of one type ion impairing the neutron generating efficiency of other type ions, thereby effecting more efficient utilization of the target material.

11 Claims, 1 Drawing Figure

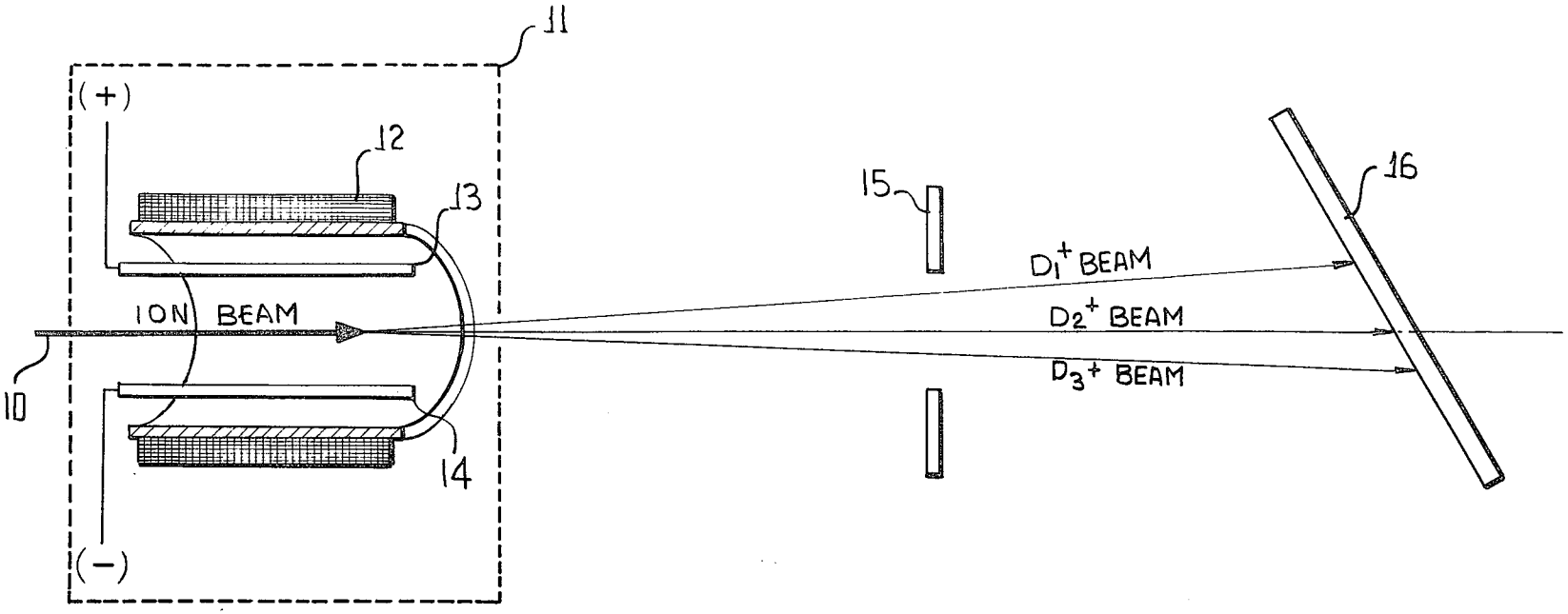
16
$D_1^+$ BEAM
$D_2^+$ BEAM
$D_3^+$ BEAM
15
11
13
14
12
ION BEAM
(+)
(−)
10

BEAM SPLITTING TO IMPROVE TARGET LIFE IN NEUTRON GENERATORS

BACKGROUND OF THE INVENTION

The present invention relates generally to neutron generation and, more particularly, to increasing the half-life of tritium-titanium targets when bombarded by deuterium ion beams.

In many applications, particularly in the medical field, there is an increasing need for high-intensity neutron generators. A relatively simple and inexpensive neutron generator utilizes a tritium-loaded, titanium-coated, rotating copper target which is bombarded by deuterium ions accelerated by a few hundred keV. However, a serious roadblock to the practical utilization of such generators is caused by the relatively short useful life-time of the target. As described by R. Booth and H. H. Barschall in "Tritium Target For Intense Neutron Source," *Nuclear Instruments and Methods* No. 99, February, 1972, pages 1–4, the depletion rate of the tritium-titanium target is very strongly influenced by the presence of molecular ions in the deuteron beam. Specifically, deuterium beams, such as are obtained from duoplasmatron-type ion sources, contain deuterons (i.e., monatomic deuterium ions) as well as diatomic and triatomic molecular deuterium ions. For a given beam energy, the deuterons penetrate the target material to a greater depth or range than the diatomic ions which, in turn, penetrate to a greater depth than the triatomic ions. This difference in penetration or range is due to the differences in sharing of acceleration energy by the ions of different mass. At or near the end of their penetrations, the ions displace tritium atoms from the titanium matrix in a relatively thin layer. The neutron-producing reactions, on the other hand, are most prevalent for each ion type a short distance back (i.e., closer to the target surface from the location of maximum penetration; that is, neutron generation is most prevalent where the ions still have approximately 100 keV of residual energy. The diatomic ions, with lesser penetration depths than the atomic ions, tend to displace tritium atoms at a depth which corresponds to the maximum neutron-producing depth of the atomic ions. The depletion of tritium at this depth seriously reduces the useful life of the target. Similarly, the triatomic ions tend to displace tritium atoms at the most efficient neutron-producing depth of the diatomic ions. The triatomic ions themselves are not very effective in neutron production because of their relatively low particle energies and because their maximum neutron-production region is at or near the target surface which is often contaminated by oxygen, carbon and organic material from vacuum seals. The end result is a useful target life which is far less than optimum.

A number of approaches to extending the useful target life have been suggested. One approach accelerates the mixed ion beam to full energy and then separates the ions with a powerful magnet before bombardment of the target. Only one of the thusly separated mass constituents of the beam is permitted to strike the target. This method eliminates the harmful interference by one ion type with another, but does so by introducing a number of disadvantageous features. For one thing, since two ion types are eliminated from bombardment, the particle accelerator is required to deliver between two and three times the beam current that is actually used. Moreover, the beam-separating magnet must be quite large to achieve sufficient separation of the high energy particles. Further, the stops for the rejected beam components must be capable of dissipating a substantial amount of energy. The resulting structure is thus large, costly and wasteful of energy.

Another prior art approach to increasing target life involves magnetic separation of the ion constituents before the beam is accelerated. This is performed in the high voltage terminal of the apparatus where the ions are at low energy levels and can therefore be deflected sufficiently with a relatively small magnet. This approach requires only the selected ion mass to be accelerated to full energy; however, such desirable result is achieved only with the introduction of additional complexity. The high energy beam must be extracted and focussed, by means of an electrostatic lens, onto a cooled apertured plate arranged to reject the two discarded ion types. This plate is located beyond the mass-separating magnet but still inside the high voltage terminal. A second lens is required to re-focus the single-constituent beam through the accelerator and onto the target. Still another control adjustment is necessary in order to obtain the correct deflection angle through the magnet. The apertured mass-rejection plate requires that there be a cooling facility and a vacuum-pumping capability within the high voltage terminal.

In both of the aforementioned prior art arrangements, "in-line" accelerator configurations are not possible because all three beam constituents must be deflected off-line during separation. In the second-mentioned apparatus, the beam position is also unstable because the long distance between the separation magnet and the target renders automatic control difficult.

It is therefore an object of the present invention to provide a simple and inexpensive approach to improving the useful life of the target in a neutron generator of the type described.

It is an object of the present invention to achieve increased target life in a neutron generator of the type described with minimal waste of energy.

It is another object of the present invention to take maximum advantage of the neutron-producing characteristics of the different ion mass constituents of a deuterium ion beam to achieve increased useful life of a tritium-titanium target.

It is still another object of the present invention to achieve improved target life in a neutron generator of the type described wherein an "in-line" accelerator may be employed.

SUMMARY OF THE INVENTION

In accordance with the present invention, the mixed ion beam is separated after acceleration with a weak magnetic field which barely separates the constituent ions. The result is three deuterium beams (one atomic, one diatomic, and one triatomic), each striking the tritium-titanium target at different adjacent locations. Since the ions of different mass penetrate the target at different locations, the shallower-penetrating ions do not displace tritium atoms in the maximum neutron-producing region of the deeper-penetrating ions. Ions of all three types are therefore able to efficiently generate neutrons and there is no wasted beam current nor requirement for large magnets. In a particular embodiment the slight separation is achieved with a crossed-field analyzer which is adjusted so that the diatomic ions pass undeflected while the atomic and triatomic atoms are deflected slightly to opposite sides. This arrangement permits an in-line accelerator to be used.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawings, wherein:

The FIGURE is a schematic illustration of a preferred embodiment of the invention.

DESCRIPTION OF THE PREFERRED EMBODIMENT

Referring to the drawing in greater detail, an ion beam 10 is composed of deuterons $D_1^+$ (atomic deuterium ions), diatomic $D_2^+$ and triatomic $D_3^+$ moleclar deuterium ions. Beam 10 is passed through a crossed-field analyzer 11 including a magnetic field coil 12 and a pair of opposed electric field plates 13, 14. In such analyzers, as well known in the art of particle beam separation, the magnetic field separates the particles of different mass whereas the electric field deflects the entire beam. By proper adjustment of the electric and magnetic fields, the beam 10 can be separated so that the diatomic ions $D_2^+$ pass through the analyzer undeflected while the monatomic ions $D_1^+$ and triatomic ions $D_3^+$ are deflected only slightly to opposite sides of the diatomic ion beam. That is, the lighter monatomic ions $D_1^+$ are deflected to one side while the heavier triatomic ions $D_3^+$ are deflected to the opposite side. This is a technique known as "velocity selection" which is well known in particle acceleration and mass spectrometry technology.

The three separated beams pass through an apertured plate 15 and impinge upon a neutron target disc 16. The beam separation is typically such that, upon reaching target 16, the three beams have cross-sectional diameters on the order of 1 cm and strike the target in adjacent or proximate locations. The three beam spots thus define a line across the target surface. In actual practice the spacing between the atomic and diatomic beams is slightly greater than the spacing between the diatomic and triatomic beams.

In a preferred embodiment the target 16 comprises a copper backing, on the order of 1 mm thick, onto which is vapor-plated a layer of titanium of density on the order of 3 to 5 mg/cm$^2$. Tritium is absorbed in the titanium to an average concentration of about 1.2 tritium atoms to 1 titanium atom.

With the monatomic, diatomic and triatomic deuterium ions following different penetration paths into the target, the tendency of each ion type to displace tritium ions at different depths has no effect on the ability of the other ions to generate neutrons at corresponding depths. That is, whereas in the unseparated beam the diatomic ions deplete tritium in the maximum neutron generation region of the monatomic ions, the separated monatomic and diatomic beams do away with this problem. Likewise, the tritium atom displacement by triatomic deuterium atoms has no effect on neutron generation by the separated diatomic ion beam. Importantly, however, and unlike the prior art, all three separated beams of ions are effective to generate neutrons as they penetrate the target. There is no rejection of ions so the entire beam current is used.

The use of cross-field analyzer 11 instead of a simple magnet is preferable for accelerators of the "in-line" type wherein one of the three separated ion beams remains undeflected and along the accelerator axis and the other two beams are positioned adjacent the first and on opposite sides thereof. If an "in-line" accelerator is not a requirement, a simple magnet may be employed, whereby all three beams would still be slightly separated but would all be deflected from the accelerator axis. In any case, only a small deflecting magnet is required because only a small degree of separation is required.

The technique of the present invention involves far less expense than the prior art techniques discussed above. Specifically, only a weak magnet is used because of the small deflection angles required. There is no need for a rejection plate to eliminate unwanted ions because all three ion types bombard the target. The requirements for a second electrostatic lens, deflection controls within the high voltage terminal, and a vacuum pump within the high voltage terminal are avoided.

The approach of the present invention is also more reliable than prior art approaches to increasing target life. Specifically, the ion source emission required to achieve a given neutron yield rate is reduced by a factor of two or three since all of the ions are used in the generation of neutrons. Likewise the gas flow from the ion source to the vacuum pump is reduced two- or three-fold. The energy dissipated in the ion source is also reduced. Further, the useful lives of the ion source exit aperture and filament are increased.

The system of the present invention is simpler than the prior art systems described herein since fewer controls are required to achieve the desired focusing and deflection. This is important where beam control is achieved automatically.

It should be noted that the overall beam may be scanned in a conventional manner, such as by superimposing an A.C. component on the electric field. Such scanning, along with the target rotation, reduces the cooling requirement at the target.

While I have described and illustrated specific embodiments of my invention, it will be clear that variations of the details of construction which are specifically illustrated and described may be resorted to without departing from the true spirit and scope of the invention as defined in the appended claims.

I claim:

1. Apparatus for generating neutrons with a source beam containing atomic and diatomic molecular deuterium ions, said apparatus being characterized by:

a target including material which emits neutrons when bombarded with atomic and diatomic molecular deuterium ions;

means for separating said source beam into a first beam containing substantially only atomic deuterium ions and a second beam containing substantially only diatomic deuterium ions; and means for directing said first and second beams onto said target such that each beam strikes said target at a different location.

2. The apparatus according to claim 1 further characterized in that said source beam additionally contains triatomic molecular deuterium ions, wherein said means for separating additionally separates a third beam containing substantially only said triatomic ions from said source beam, and wherein said means for directing also directs said third beam onto said target at a location different from locations locaions at which said first and second beams strike said target.

3. The apparatus according to claim 2 wherein said means for separating is a relatively weak field-producing means which separates said first, second and third beams into adjacent positions such that each strikes said target along a continuous transverse line.

4. The apparatus according to claim 2 wherein said target material is tritium absorbed in titanium.

5. The apparatus according to claim 4 wherein said means for separating is a crossed-field analyzer arranged to permit said second beam to pass therethrough undeflected and to deflect said first and third beams slightly to opposite sides of said second beam.

6. The apparatus according to claim 2 wherein said means for separating is a crossed-field analyzer arranged to permit said second beam to pass therethrough undeflected and to deflect said first and third beams slightly to opposite sides of said second beam.

7. The apparatus according to claim 1 wherein said target material is tritium absorbed in titanium.

8. The apparatus according to claim 1 wherein said means for separating includes means for deflecting said source beam to vary the locations at which said plural beams strike said target.

9. In a neutron generator of the type wherein ions of different mass in a source beam impinge upon a target and the ions of each mass penetrate said target to a different depth, the method of preventing ions of one mass from impairing the neutron generation capability at said target of ions of other masses, said method comprising the steps of:

separating said source beam into plural beams each containing substantially only ions having a respective mass; and directing all of said plural beams onto said target at different locations.

10. The method according to claim 8 further including the step of deflecting said source beam to vary the locations at which said plural beams strike said target.

11. In a neutron generator of the type wherein ions of different mass in a source beam impinge upon a target and the ions of each mass penetrate said target to a different depth, the method of preventing ions of one mass from impairing the neutron generation capability at said target of ions of other masses, said method comprising the steps of:

separating said source beam into first, second and third beams containing substantially only said atomic, diatomic and triatomic ions, respectively; and directing all of said first, second and third beams onto a target such that all three beams strike said target at different locations.

* * * * *

Notice of Adverse Decision in Interference

In Interference No. 99,481, involving Patent No. 3,968,377, J. P. Farrell, BEAM SPLITTING TO IMPROVE TARGET LIFE IN NEUTRON GENERATORS, final judgment adverse to the patentee was rendered Sept. 22, 1977, as to claims 1, 7, 8, 9 and 10.

[*Official Gazette December 20, 1977.*]